US009716370B2

(12) United States Patent
Yamamura et al.

(10) Patent No.: US 9,716,370 B2
(45) Date of Patent: Jul. 25, 2017

(54) SPARK PLUG

(71) Applicant: NGK SPARK PLUG CO., LTD., Nagoya-shi, Aichi (JP)

(72) Inventors: Naofumi Yamamura, Nagoya (JP); Kuniyuki Ishii, Gifu (JP); Naoya Onoda, Komaki (JP); Hiroyuki Odo, Kounan (JP)

(73) Assignee: NGK SPARK PLUG CO., LTD., Nagoya-shi (JP)

( * ) Notice: Subject to any disclaimer, the term of this patent is extended or adjusted under 35 U.S.C. 154(b) by 0 days.

(21) Appl. No.: 15/168,696

(22) Filed: May 31, 2016

(65) Prior Publication Data

US 2016/0365707 A1 Dec. 15, 2016

(30) Foreign Application Priority Data

Jun. 9, 2015 (JP) ..... 2015-116285
Mar. 29, 2016 (JP) ..... 2016-065141

(51) Int. Cl.

| | |
|---|---|
| ***H01T 13/20*** | (2006.01) |
| ***H01J 13/32*** | (2006.01) |
| ***H01T 13/39*** | (2006.01) |
| ***H01T 13/32*** | (2006.01) |
| *H01T 13/16* | (2006.01) |

(52) U.S. Cl.
CPC ..... *H01T 13/39* (2013.01); *H01T 13/20* (2013.01); *H01T 13/32* (2013.01); *H01T 13/16* (2013.01)

(58) Field of Classification Search
CPC ..... H01T 13/20; H01T 13/32; H01T 21/00
See application file for complete search history.

(56) References Cited

U.S. PATENT DOCUMENTS 4,023,058 A * 5/1977 Lara ..... H01T 13/20 313/11.5
5,196,760 A * 3/1993 Takamura ..... H01T 13/20 313/141
5,406,166 A 4/1995 Abe et al. ..... 313/142
(Continued)

FOREIGN PATENT DOCUMENTS

EP 0535584 A2 4/1993 ..... H01T 13/39
JP 91-201383 A 9/1991 ..... H01T 13/20
(Continued)

OTHER PUBLICATIONS

Extended European Search Report issued in corresponding European Patent Application No. 16173146.8, dated Oct. 21, 2016.

*Primary Examiner* — Mariceli Santiago
(74) *Attorney, Agent, or Firm* — Kusner & Jaffe

(57) ABSTRACT

A spark plug includes a metal shell, an insulator, a center electrode, and a ground electrode. At least one of the center electrode and the ground electrode includes a projection having a columnar shape. The projection projects toward the other of the center electrode and the ground electrode and forms the discharge gap. A portion of a side surface of the projection has a recess. A melted portion is formed by melting the noble metal tip and an electrode base material. The recess is formed in the melted portion. When D is a depth of the recess from a side surface of the noble metal tip and R is a diameter of the noble metal tip, 0.05 mm≤D≤0.3×R is satisfied.

5 Claims, 5 Drawing Sheets

(56) References Cited

U.S. PATENT DOCUMENTS

| | | | | | |
|---|---|---|---|---|---|
| 5,448,130 | A * | 9/1995 | Matsutani | H01T 13/39 | 313/141 |
| 6,078,129 | A * | 6/2000 | Gotou | H01T 21/02 | 313/141 |
| 6,597,089 | B2 * | 7/2003 | Matsutani | H01T 13/39 | 313/141 |
| 6,846,214 | B1 | 1/2005 | Gotou et al. | 445/7 | |
| 8,044,562 | B2 | 10/2011 | Musasa et al. | 313/141 | |
| 8,907,552 | B2 * | 12/2014 | Katsuraya | F02P 3/01 | 313/118 |
| 2009/0289540 | A1 * | 11/2009 | Nunome | C22C 5/04 | 313/141 |
| 2010/0264796 | A1 | 10/2010 | Musasa et al. | 313/11.5 | |
| 2013/0229102 | A1 | 9/2013 | Raasch et al. | 313/11.5 | |
| 2014/0292178 | A1 * | 10/2014 | Hartmann | H01T 13/20 | 313/141 |

FOREIGN PATENT DOCUMENTS

| | | | | |
|---|---|---|---|---|
| JP | 99-003765 | A | 1/1999 | H01T 13/39 |
| JP | 2003-249325 | A | 9/2003 | B23K 26/00 |
| JP | 2012-190737 | A | 10/2012 | H01T 13/20 |
| JP | 2013-108465 | A | 6/2013 | F02P 15/00 |
| WO | WO 2009/063914 | A1 | 5/2009 | H01T 13/32 |

* cited by examiner

FIG. 7

| | RESIDUAL RATIO (%) | BREAKAGE |
|---|---|---|
| NOBLE METAL TIP DIAMETER 0.4 mm | 100 | NO |
| | 80 | NO |
| | 75 | NO |
| | 70 | NO |
| | 65 | YES |

FIG. 8

| | RESIDUAL RATIO (%) | BREAKAGE |
|---|---|---|
| NOBLE METAL TIP DIAMETER 1.2 mm | 100 | NO |
| | 80 | NO |
| | 75 | NO |
| | 70 | NO |
| | 65 | YES |

SPARK PLUG

RELATED APPLICATION

This application claims the benefit of Japanese Patent Application No. 2015-116285, filed Jun. 9, 2015, and Japanese Patent Application No. 2016-065141, filed Mar. 29, 2016.

FIELD OF THE INVENTION

The present invention relates to a spark plug.

BACKGROUND OF THE INVENTION

The ignitability of spark plugs has been increased by, for example, increasing the ignition energy applied to the spark plug (see Japanese Unexamined Patent Application Publication No. 2013-108465).

However, to increase the ignition energy, an ignition coil or the like capable of generating a large amount of energy is required, and therefore the cost of the entire ignition system is increased.

Accordingly, a technology for increasing the ignitability of a spark plug with a simple structure is in demand.

The present invention has been made to solve the above-described problem, and can be embodied in the following forms.

SUMMARY OF THE INVENTION (1) In accordance to a first aspect of the present invention, there is provided a spark plug that includes a metal shell having a tubular shape; an insulator having an axial hole that extends along an axial line, at least a portion of a periphery of the insulator being held by the metal shell; a center electrode disposed in the axial hole; and a ground electrode that is fixed to the metal shell and that forms a discharge gap between the ground electrode and the center electrode. At least one of the center electrode and the ground electrode includes a projection having a columnar shape, the projection projecting toward the other of the center electrode and the ground electrode and forming the discharge gap. A portion of a side surface of the projection has a recess. The projection includes a noble metal tip having a cylindrical shape disposed at a side adjacent to the discharge gap, and a melted portion disposed at a side of the noble metal tip opposite to the side adjacent to the discharge gap, the melted portion being formed by melting the noble metal tip and an electrode base material. The recess is formed in the melted portion. When D is a depth of the recess from a side surface of the noble metal tip and R is a diameter of the noble metal tip, following condition (1) is satisfied:

$$0.05\ \text{mm} \leq D \leq 0.3 \times R \quad (1)$$

The spark plug according to this aspect is configured such that the recess is formed in a portion of the side surface of the projection that projects toward the discharge gap. The recess suppresses heat conduction from the end of the projection, so that the temperature of the end of the projection is maintained high. As a result, the flame quenching effect of the electrode is suppressed, and the ignitability is increased. Thus, the ignitability of the spark plug can be increased with a simple structure. Since the recess is formed in the melted portion, the recess can be easily formed. In addition, since the projection includes the noble metal tip, the durability of the electrode can be increased. Furthermore, since the depth D of the recess and the diameter R of the noble metal tip satisfy the above condition (1), the ignitability of the spark plug can be reliably increased.

(2) In accordance with a second aspect of the present invention, there is provided a spark plug as above-described, wherein, when T is a dimension of an opening of the recess in a direction of a central axis of the projection, following condition (2) is satisfied:

$$T \geq 0.2\ \text{mm} \quad (2)$$

With such a spark plug, the ignitability of the spark plug can be appropriately increased.

(3) In accordance with a third aspect of the present invention, there is provided a spark plug as above-described, wherein, the projection may be provided with a plurality of the recesses. With such a spark plug, the ignitability of the spark plug can be more appropriately increased.

(4) In accordance with a fourth aspect of the present invention, there is provided a spark plug as above-described, wherein, the center electrode may include the projection. With such a spark plug, the flame quenching effect of the center electrode can be reduced.

(5) In accordance with a fifth aspect of the present invention, there is a spark plug as above-described, wherein, the ground electrode may include the projection. With such a spark plug, the flame quenching effect of the ground electrode can be reduced.

The present invention may be embodied in various forms, such as a method for manufacturing a spark plug as well as the above-described spark plug.

BRIEF DESCRIPTION OF THE DRAWINGS

FIG. 7 shows the result of a first vibration evaluation test;

FIG. 8 shows the result of a second vibration evaluation test;

DETAILED DESCRIPTION OF THE PREFERRED EMBODIMENTS

A. Embodiment

Figure 1:
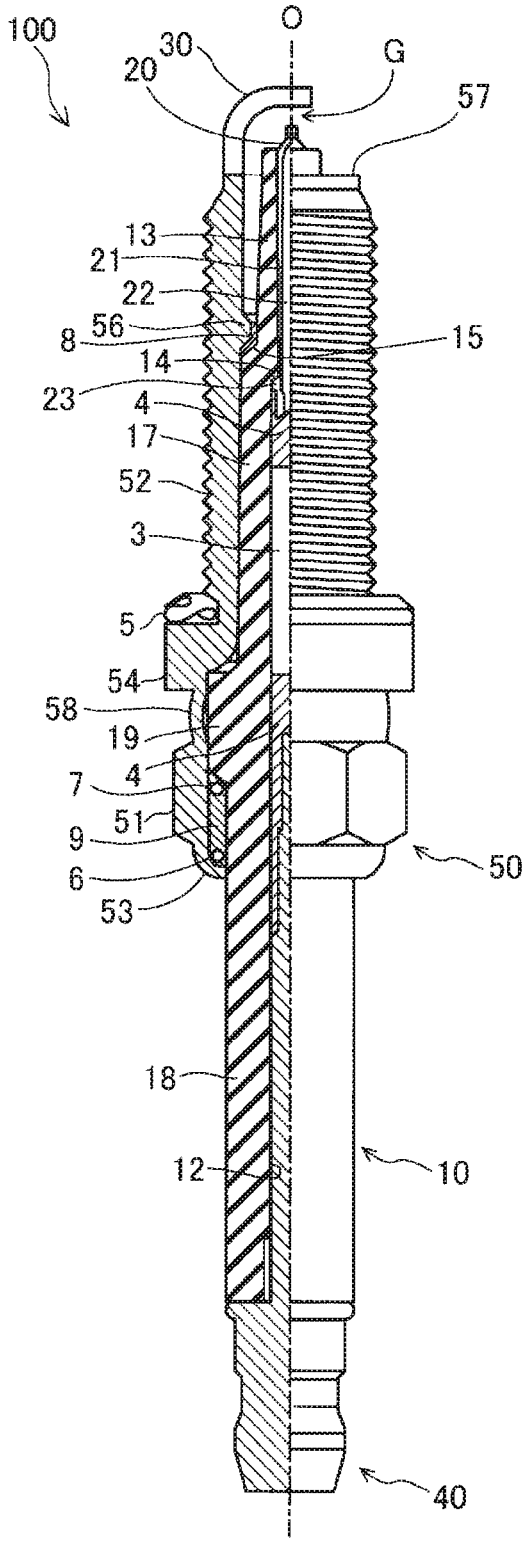
FIG. 1 is a partially sectioned view of a spark plug.

FIG. 1 is a partially sectioned view of a spark plug 100 according to an embodiment of the present invention. The spark plug 100 has a thin long shape that extends along an axial line O. In FIG. 1, an external front view of the spark plug 100 is shown on the right side of the axial line O, which is represented by the dotted chain line, and a sectional view of the spark plug 100 along the axial line O is shown on the left side of the axial line O. In the following description, the upper side of FIG. 1 is referred to as the front side of the spark plug 100, and the lower side of FIG. 1 as the rear side of the spark plug 100.

The spark plug 100 includes an insulator 10, a center electrode 20, a ground electrode 30, and a metal shell 50. The insulator 10 has an axial hole 12 that extends along the axial line O, and at least a portion of the periphery of the insulator 10 is held by a metal shell 50 having a tubular shape. The center electrode 20 is disposed in the axial hole 12. The ground electrode 30 is fixed to a front end surface 57 of the metal shell 50, and a discharge gap G is formed between the center electrode 20 and the ground electrode 30.

The insulator 10 is formed by sintering a ceramic material, such as alumina. The insulator 10 is a tubular member having the axial hole 12 at the center. The axial hole 12 houses a portion of the center electrode 20 at the front side and a portion of a terminal 40 at the rear side. The insulator 10 includes a central body portion 19 having a large diameter at the center thereof in the axial direction. A rear-side body portion 18, which provides insulation between the terminal 40 and the metal shell 50, is provided on a side of the central body portion 19 that is adjacent to the terminal 40. A front-side body portion 17, which has an outer diameter smaller than that of the rear-side body portion 18, is provided on a side of the central body portion 19 that is adjacent to the center electrode 20. A leg portion 13, which has an outer diameter that is smaller than that of the front-side body portion 17 and decreases toward the center electrode 20, is formed on the front side of the front-side body portion 17.

The metal shell 50 is a member having a tubular shape that surrounds and holds the insulator 10 over a region from a portion of the rear-side body portion 18 to the leg portion 13. The metal shell 50 is made of, for example, a low-carbon steel, and the entirety thereof is plated with, for example, nickel or zinc. The metal shell 50 includes a tool engagement portion 51, a sealing portion 54, and a threaded portion 52 in that order from the rear side. A tool used to attach the spark plug 100 to an engine head engages with the tool engagement portion 51. The threaded portion 52 has a thread that engages with a threaded hole formed in the engine head. The sealing portion 54 is flange-shaped and is provided at the base of the threaded portion 52. An annular gasket 5, which is formed by bending a plate, is interposed between the sealing portion 54 and the engine head. The front end surface 57 of the metal shell 50 has an annular shape, and the leg portion 13 of the insulator 10 and the center electrode 20 project through the front end surface 57 at the center thereof.

The metal shell 50 includes a thin crimping portion 53 on the rear side of the tool engagement portion 51. A compressive deformation portion 58, which is as thin as the crimping portion 53, is provided between the sealing portion 54 and the tool engagement portion 51. Annular ring members 6 and 7 are disposed between the outer peripheral surface of the rear-side body portion 18 of the insulator 10 and the inner peripheral surface of the metal shell 50 in a region from the tool engagement portion 51 to the crimping portion 53. The space between the ring members 6 and 7 is filled with powder of talc 9. In the manufacturing process of the spark plug 100, the crimping portion 53 is bent inward and pressed toward the front side so that the compressive deformation portion 58 is compressed and deformed. Accordingly, the insulator 10 is pressed toward the front side by the ring members 6 and 7 and the talc 9 in the metal shell 50, so that the talc 9 is compressed in the direction of the axial line O and the airtightness of the metal shell 50 is increased.

A metal-shell stepped portion 56 is formed on the inner peripheral surface of the metal shell 50 at a position where the threaded portion 52 is provided, and an insulator stepped portion 15 is provided at the proximal end of the leg portion 13 of the insulator 10. The insulator stepped portion 15 is pressed against the metal-shell stepped portion 56 with an annular plate packing 8 interposed therebetween. The plate packing 8 ensures sufficient airtightness between the metal shell 50 and the insulator 10, thereby preventing leakage of the combustion gas.

The ground electrode 30 is made of a metal with high corrosion resistance. An example of a metal with high corrosion resistance is a nickel alloy containing nickel as the main component, such as Inkonel (trade name) 600 or Inconel 601. The proximal end of the ground electrode 30 is welded to the front end surface 57 of the metal shell 50. In the present embodiment, the ground electrode 30 is bent at an intermediate portion thereof so that a side surface of a front end portion of the ground electrode 30 faces the center electrode 20. The ground electrode 30 may have a two-layer structure in which copper or a copper alloy is embedded in a base material made of the above-mentioned nickel alloy. Alternatively, the ground electrode 30 may have a three-layer structure in which nickel or a nickel alloy is embedded in the copper or copper alloy. Here, the main component of an object is a component with the highest percentage by mass, and the percentage by mass of the main component does not necessarily exceed 50 mass %.

The center electrode 20 is a rod-shaped member in which a core material 22 with high thermal conductivity is embedded in an electrode base material 21. The electrode base material 21 is made of a nickel alloy containing nickel as the main component, and the core material 22 is made of copper or an alloy containing copper as the main material.

The center electrode 20 includes a flange portion 23, which is shaped so as to project outward, at a position near the rear end thereof. The flange portion 23 comes into contact with an axial-hole stepped portion 14, which is formed in the axial hole 12, from the rear side, so that the center electrode 20 is positioned in the insulator 10. The rear end portion of the center electrode 20 is electrically connected to the terminal 40 through a ceramic resistor 3 and a sealing member 4.

Figure 2:
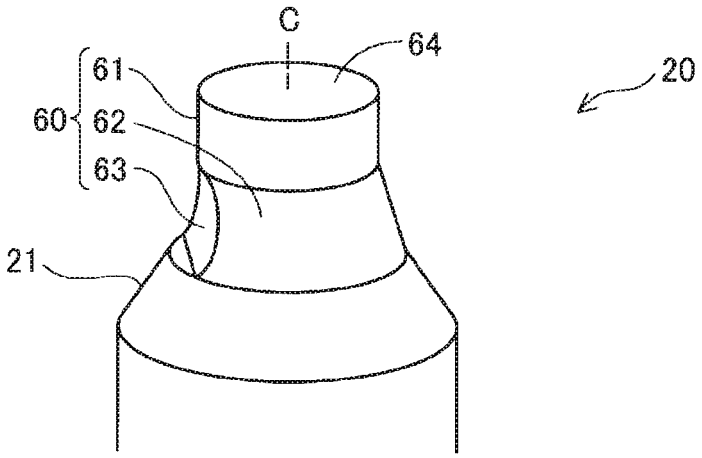
FIG. 2 is a perspective view of a front end portion of a center electrode.

FIG. 2 is a perspective view of a front end portion of the center electrode 20. In the present embodiment, the center electrode 20 includes a projection 60 having a columnar shape at the front end thereof. The projection 60 projects towards the other electrode, that is, the ground electrode 30, so as to form the discharge gap G. The projection 60 includes a noble metal tip 61 having a cylindrical shape located adjacent to the discharge gap G, and a melted portion 62 located at a side of the noble metal tip 61 opposite to the side adjacent to the discharge gap G. The melted portion 62 is formed by melting the electrode base material 21 and the noble metal tip 61. The noble metal tip 61 is made of, for example, platinum (Pt), iridium (Ir), ruthenium (Ru), rhodium (Rh), or an alloy thereof. In the present embodiment, the electrode base material 21 has a diameter greater than that of the projection 60. The front end portion of the electrode base material 21 is tapered and connected to the melted portion 62.

A recess 63 is formed in the side surface of the projection 60. In the present embodiment, the recess 63 is formed in the melted portion 62. The melted portion 62 is formed by irradiating the boundary between the electrode base material 21 and the noble metal tip 61 with a laser beam a plurality of times by using a pulsed oscillation laser while rotating the electrode base material 21 and the noble metal tip 61 around the central axis C. In the present embodiment, the recess 63 is formed in the melted portion 62 by increasing the output level of the laser beam at any one of the times the laser beam is output. To form a circular recess 63, the output level is preferably increased when the laser beam is output for the last time. The output level of the laser beam for forming the recess 63 is determined in advance so that the dimensions of the recess 63 satisfy conditions (1) and (2) described below. In the present embodiment, the central axis C of the electrode base material 21 and the noble metal tip 61, that is, the central axis C of the projection 60, coincides with the axial line O.

Figure 3:
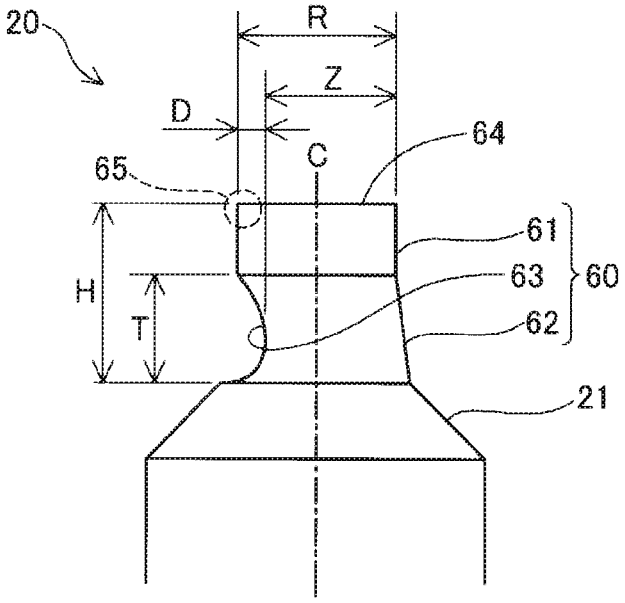
FIG. 3 illustrates the dimensions of portions of a projection.

FIG. 3 illustrates the dimensions of portions of the projection 60. The height H of the projection 60, that is, the dimension from a front end surface 64 of the noble metal tip 61 to the rear end of the melted portion 62 along the central axis C, is generally 0.5 mm to 2.5 mm, and is 2.5 mm in the present embodiment.

In the present embodiment, when the diameter of the noble metal tip 61 is R, the depth D of the recess 63 preferably satisfies condition (1) given below. The depth D of the recess 63 is the depth from the side surface of the noble metal tip 61 in the direction toward the central axis C. The diameter R of the noble metal tip 61 is 0.17 mm or more.

$$0.05\ \text{mm} \leq D \leq 0.3 \times R \quad (1)$$

In addition, in the present embodiment, when T is the dimension of the opening of the recess 63 in the direction of the central axis C of the projection 60, the dimension T preferably satisfies condition (2) given below. In the following description, the dimension T is referred to as an opening height T.

$$T \geq 0.2\ \text{mm} \quad (2)$$

The reason why the dimensions of the recess 63 of the projection 60 preferably satisfy the above conditions (1) and (2) will be described below.

The spark plug 100 according to the above-described embodiment is configured such that the recess 63 is formed in a portion of the side surface of the projection 60 provided at the front end of the center electrode 20. The recess 63 suppresses heat conduction from the front end of the center electrode 20, so that the temperature of the front end of the center electrode 20 is maintained high. As a result, the flame quenching effect of the center electrode 20 is suppressed, and the ignitability is increased. More specifically, the recess 63 suppresses heat conduction from a high temperature portion 65 (see FIG. 3), which is a portion on the front side of the recess 63 along the central axis C, so that the temperature of the electrode surface of that portion is locally increased and the thermionic emission performance is increased accordingly. This facilitates electric discharge around the high temperature portion 65, and initial flame is easily formed around the high temperature portion 65. Since the temperature is higher at the high temperature portion 65 than at other portions, the flame quenching effect is reduced and the ignitability is increased. Therefore, according to the present embodiment, the ignitability of the spark plug 100 can be increased with a simple structure in which the recess 63 is formed in the projection 60 provided at the front end of the center electrode 20. In the present embodiment, the recess is formed in a portion of the side surface of the projection 60, and is not formed over the entire periphery of the side surface. Therefore, compared to the case in which the recess is formed over the entire periphery, the local high-temperature portion can be more easily formed and the ignitability can be more effectively increased.

In the present embodiment, since the recess 63 is formed in the melted portion 62, the recess 63 can be easily formed simply by adjusting the output of the laser device. Therefore, the recess 63 can be formed without a large increase in the manufacturing cost. In addition, in the present embodiment, since the center electrode 20 includes the noble metal tip 61, the durability of the center electrode 20 can be increased.

Figure 4:
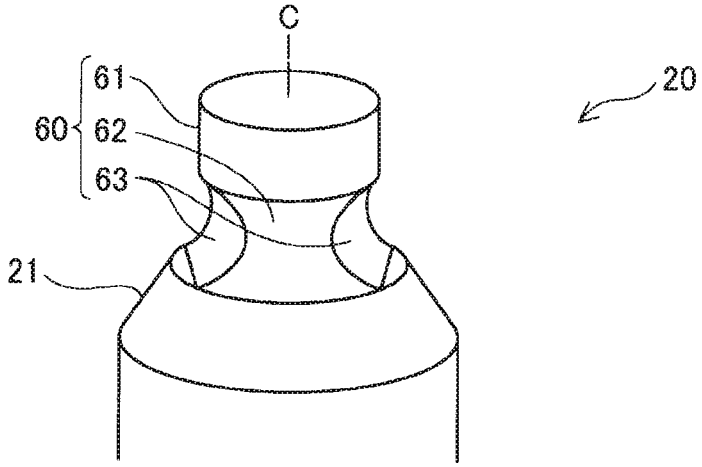
FIG. 4 illustrates an example in which a plurality of recesses are formed in a melted portion.

In the present embodiment, a single recess 63 is formed in the projection 60. However, a plurality of recesses 63 may instead be formed. FIG. 4 illustrates an example in which two recesses 63 are formed in the projection 60. In the case where a plurality of recesses 63 are formed, the recesses 63 may be arranged around the central axis C of the projection 60 with constant intervals therebetween along the side surface of the projection 60. The recesses 63 may be disposed near each other so as not to be in contact with each other.

In the present embodiment, the expression "the recess 63 is formed in a portion of the side surface of the projection 60" means that no recess is formed in a portion of the entire periphery of the side surface of the projection 60 other than the portion in which the recess 63 is formed. In other words, the outer diameter of the portion other than the portion in which the recess 63 is formed is constant, or the difference between the outer diameter and the tip diameter R is less than 0.05 mm.

B. Test Results

The reason why the dimensions of the recess 63 preferably satisfy the above conditions (1) and (2) will be described with reference to the results of various tests.

B1. First Ignitability Evaluation Test

Figure 5:
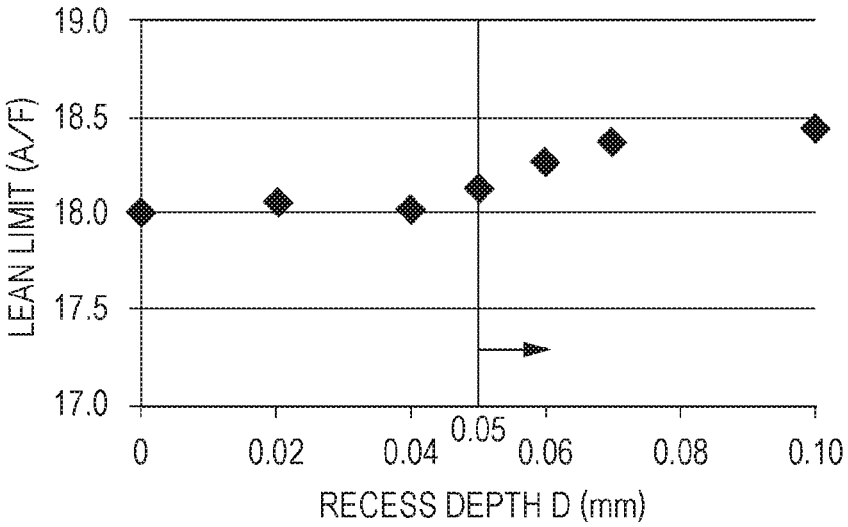
FIG. 5 is a graph showing the result of a first ignitability evaluation test.

FIG. 5 is a graph showing the result of a first ignitability evaluation test. In the first ignitability evaluation test, a plurality of samples of the spark plug 100 in which the depth D of the recess 63 was set to different values (depth D=0 mm, 0.02 mm, 0.04 mm, 0.05 mm, 0.06 mm, 0.07 mm, and 0.10 mm) were prepared. The samples were attached to a 4-cylinder engine with a displacement of 2.0 liters, and the engine was operated at a rotational speed of 1500 rpm with the ignition timing set to the minimum advance for best torque (MBT) timing. The air/fuel ratio was gradually increased, that is, the fuel content was gradually reduced, and the coefficient of variation (COV) in combustion was measured for each air/fuel ratio. The air/fuel ratio (A/F) at the time when the coefficient of variation in combustion exceeded 5% is plotted in the graph as the lean limit. In all of the samples used in this test, the diameter R of the noble metal tip 61 was 0.4 mm, the opening height T of the recess was 0.2 mm, the height H of the projection 60 was 2.5 mm, and the number of recesses was 1. Each of the values plotted in FIG. 5 is the average of the results of three measurements performed for each sample.

As is clear from FIG. 5, the result of the first ignitability evaluation test shows that, when the depth D of the recess 63 is 0.05 mm or more, the lean limit is greater and the ignitability is higher than when the depth D of the recess 63 is less than 0.05 mm.

B2. Second Ignitability Evaluation Test

Figure 6:
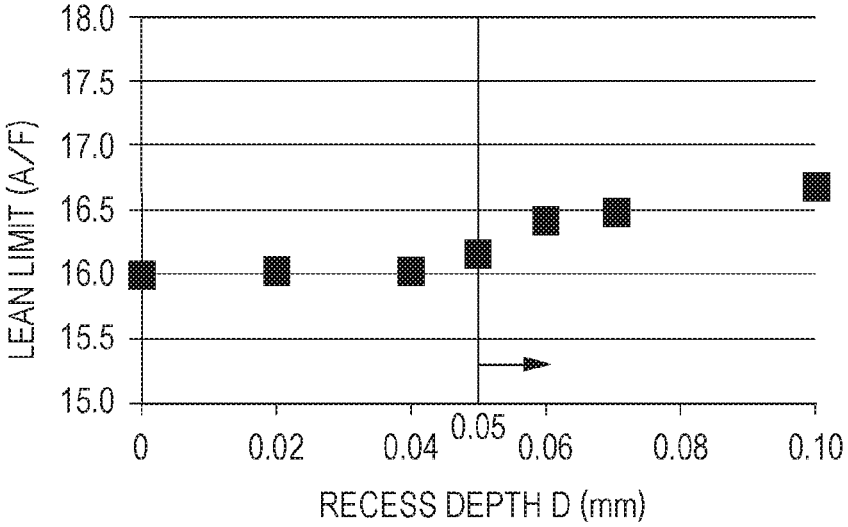
FIG. 6 is a graph showing the result of a second ignitability evaluation test.

FIG. 6 is a graph showing the result of a second ignitability evaluation test. In the second ignitability evaluation test, a test similar to the first ignitability evaluation test was performed by using samples similar to the samples of the first ignitability evaluation test except that the diameter R of the noble metal tip 61 was 1.2 mm. Each of the values plotted in FIG. 6 is the average of the results of three measurements performed for each sample.

As is clear from FIG. 6, similar to the first ignitability evaluation test, the result of the second ignitability evaluation test also shows that when the depth D of the recess 63 is 0.05 mm or more, the lean limit is greater and the ignitability is higher than when the depth D of the recess 63 is less than 0.05 mm. Thus, the first and second ignitability evaluation tests confirmed that the lower limit of the depth D of the recess 63 in the above condition (1) is preferably 0.05 mm.

B3. First Vibration Evaluation Test

FIG. 7 shows the result of a first vibration evaluation test. In the first vibration evaluation test, a plurality of samples in which the diameter R of the noble metal tip 61 was 0.4 mm and the depth D of the recess 63 was changed so that the residual ratio of the projection 60 relative to the diameter R was changed (residual ratio=65%, 70%, 75%, 80%, and 100%) were prepared. The residual ratio is the ratio of the value Z (see FIG. 3) obtained by subtracting the depth D of the recess 63 from the diameter R of the noble metal tip 61 relative to the diameter R. In this test, the samples were attached to an ultrasonic vibrator and vibrated at a vibration frequency of 27.3 kHz for 600 seconds. The frequency of 27.3 kHz is determined based on the resonance frequency of a common noble metal tip. In FIG. 7, which shows the test result, "YES" means that a breakage of the melted portion 62 between the noble metal tip 61 and the electrode base material 21 occurred, and "NO" means the melted portion 62 did not break. The opening height T of the recess 63 formed in each sample was 0.2 mm, the number of recesses 63 was 1, and the height H of the projection 60 was 2.5 mm. Each sample was tested three times under the same conditions, and "YES" in FIG. 7 showing the test result means that a breakage occurred at least once.

As is clear from FIG. 7, the result of the first vibration evaluation test shows that in the case where the diameter R of the noble metal tip 61 is 0.4 mm, no breakage occurs when the residual ratio is 70% or more, in other words, when the depth D of the recess 63 is 30% or less of the diameter R of the noble metal tip 61.

B4. Second Vibration Evaluation Test

FIG. 8 shows the result of a second vibration evaluation test. In the second vibration evaluation test, a test similar to the first vibration evaluation test was performed by using samples in which the diameter R of the noble metal tip 61 was 1.2 mm. Each sample was tested three times under the same conditions, and "YES" in FIG. 8 showing the test result means that a breakage occurred at least once.

As is clear from FIG. 8, similar to the first vibration evaluation test, the result of the second vibration evaluation test shows that also in the case where the diameter R of the noble metal tip 61 is 1.2 mm, no breakage occurs when the residual ratio is 70% or more, in other words, when the depth D of the recess 63 is 30% or less of the diameter R of the noble metal tip 61. Thus, the first and second vibration evaluation tests confirmed that the upper limit of the depth D of the recess 63 in the above condition (1) is preferably 0.3×R.

The first and second ignitability evaluation tests and the first and second vibration evaluation tests show that, by forming the recess 63 in the projection 60 such that the above condition (1) is satisfied, the ignitability can be increased while the occurrence of a breakage of the projection 60 is suppressed.

B5. Third Ignitability Evaluation Test

Figure 9:
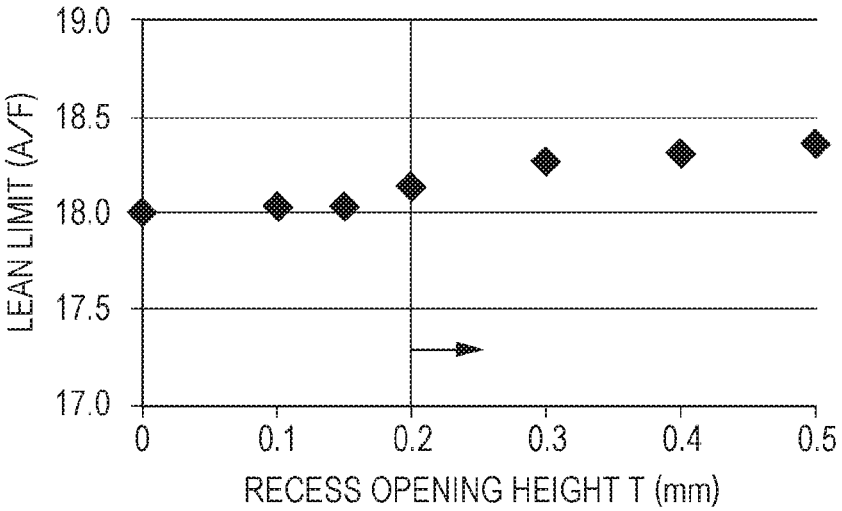
FIG. 9 is a graph showing the result of a third ignitability evaluation test.

FIG. 9 is a graph showing the result of a third ignitability evaluation test. In the third ignitability evaluation test, a test that is the same as the first ignitability evaluation test was performed by using each of a plurality of samples of the spark plug 100 in which the opening height T of the recess 63 was changed (T=0 mm, 0.1 mm, 0.15 mm, 0.2 mm, 0.3 mm, 0.4 mm, and 0.5 mm). In all of the samples used in this test, the diameter R of the noble metal tip 61 was 0.4 mm, the depth D of the recess 63 was 0.05 mm, the height H of the projection 60 was 2.5 mm, and the number of recesses 63 was 1. Each of the values plotted in FIG. 9 is the average of the results of three measurements performed for each sample.

As is clear from FIG. 9, the result of the third ignitability evaluation test shows that when the opening height T of the recess 63 is 0.2 mm or more, the lean limit is greater and the ignitability is higher than when the opening height T of the recess 63 is less than 0.2 mm. Thus, the ignitability is increased when the opening height T of the recess 63 satisfies the above condition (2).

B6. Fourth Ignitability Evaluation Test

Figure 10:
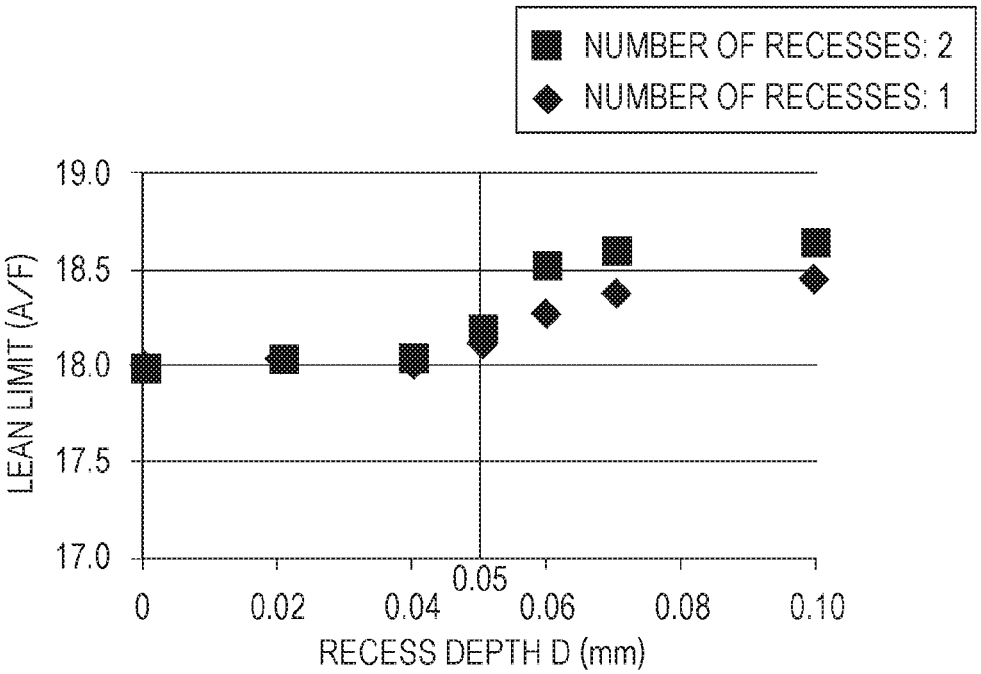
FIG. 10 is a graph showing the result of a fourth ignitability evaluation test.

FIG. 10 is a graph showing the result of a fourth ignitability evaluation test. In the fourth ignitability evaluation test, a test similar to the first ignitability evaluation test was performed by using a plurality of samples in each of which two recesses 63 having the same shape were arranged symmetrically about the central axis C of the projection 60. The conditions of the samples were the same as those of the samples used in the first ignitability evaluation test except for the number of recesses 63. Each of the values plotted in FIG. 10 is the average of the results of three measurements performed for each sample. In addition to the result of the fourth ignitability evaluation test (number of recesses: 2), FIG. 10 also shows the result of the first ignitability evaluation test (number of recesses: 1) for reference.

As is clear from FIG. 10, the fourth ignitability evaluation test confirmed that it is more preferable to form a plurality of recesses 63 in the projection 60 than to form a single recess 63 in the projection 60, particularly when the depth D of the recesses 63 is 0.05 mm or more. In this test, two recesses 63 were arranged symmetrically about the central axis C of the projection 60. However, to form a local high-temperature portion, the recesses 63 may instead be arranged near each other so as not to be in contact with each other.

C. Modifications

First Modification

In the above-described embodiment, the projection 60 includes the noble metal tip 61 having a cylindrical shape. However, the shape of the noble metal tip 61 is not limited to a cylindrical shape. Furthermore, the noble metal tip 61 of the projection 60 may be omitted. In such a case, the projection 60 is composed of the electrode base material 21, and the recess 63 is formed in the side surface of the electrode base material 21.

Second Modification

In the above-described embodiment, the recess 63 is formed in the projection 60 during the laser welding process. However, the recess 63 may instead be formed by, for example, a cutting process using a drill or the like or a punching process.

Third Modification

In the above-described embodiment, the center electrode 20 includes the projection 60. However, the projection may instead be provided on the ground electrode 30. More specifically, for example, an intermediate member made of the same type of material as the base material of the ground electrode 30 is formed on an inner surface of the ground electrode 30 as an electrode base material, and a noble metal tip is welded to the intermediate member. Then, a melted portion is formed on a bonding portion between the intermediate member and the noble metal tip. Recesses that are shaped similarly to the recesses illustrated in FIGS. 2 and 3 are formed in the melted portion. With such a structure, the temperature of the front end of the ground electrode 30 is maintained high, so that the flame quenching effect of the ground electrode 30 is reduced and the ignitability is increased. It is not necessary that the projection be provided on only one of the front end portion of the center electrode 20 and the front end portion of the ground electrode 30, and the projection may be provided on each of the center electrode 20 and the ground electrode 30.

The present invention is not limited to the above-described embodiments and modifications, and may be embodied in various forms without departing from the gist thereof. For example, the technical features of the embodiments and modifications corresponding to the technical features according to the aspects described in the Summary of the Invention section may be replaced or combined as appropriate to solve some or all of the above-described problems or obtain some or all of the above-described effects. The technical features may also be omitted as appropriate unless they are described as being essential in this specification.

Having described the invention, the following is claimed:

1. A spark plug comprising:

a metal shell having a tubular shape;

an insulator having an axial hole that extends along an axial line, at least a portion of a periphery of the insulator being held by the metal shell;

a center electrode disposed in the axial hole; and a ground electrode that is fixed to the metal shell and that forms a discharge gap between the ground electrode and the center electrode, wherein at least one of the center electrode and the ground electrode includes a projection having a columnar shape, the projection projecting toward the other of the center electrode and the ground electrode and forming the discharge gap, wherein only a portion of an entire periphery of a side surface of the projection has a recess, wherein the projection includes a noble metal tip having a cylindrical shape disposed at a side adjacent to the discharge gap, and a melted portion disposed at a side of the noble metal tip opposite to the side adjacent to the discharge gap, the melted portion comprised of melted sections of the noble metal tip and an electrode base material, wherein the recess is formed in the melted portion, and wherein, when D is a depth of the recess from a side surface of the noble metal tip and R is a diameter of the noble metal tip, following condition (1) is satisfied:

$$0.05\ \text{mm} \leq D \leq 0.3 \times R \quad (1).$$

2. The spark plug according to claim 1, wherein, when T is a dimension of an opening of the recess in a direction of a central axis of the projection, following condition (2) is satisfied:

$$T \geq 0.2\ \text{mm} \quad (2).$$

3. The spark plug according to claim 1, wherein the projection is provided with a plurality of the recesses.

4. The spark plug according to any one of claims 1 to 3, wherein the center electrode includes the projection.

5. The spark plug according to any one of claims 1 to 3, wherein the ground electrode includes the projection.

* * * * *